US007059073B2

(12) United States Patent
Beach

(10) Patent No.: US 7,059,073 B2
(45) Date of Patent: Jun. 13, 2006

(54) CARD MOUNTING AND DISPLAY DEVICE

(76) Inventor: Elizabeth A. Beach, 762 Goldenville Rd., Gettysburg, PA (US) 17325

( * ) Notice: Subject to any disclaimer, the term of this patent is extended or adjusted under 35 U.S.C. 154(b) by 25 days.

(21) Appl. No.: 10/452,616

(22) Filed: Jun. 2, 2003

(65) Prior Publication Data

US 2004/0237358 A1 Dec. 2, 2004

(51) Int. Cl.
*G09F 1/10* (2006.01)

(52) U.S. Cl. ..... 40/124; 40/657; 40/617; 206/495; 211/113; 211/45

(58) Field of Classification Search ..... 211/113, 211/118, 45; 206/6.1, 495, 806; 40/657, 40/124, 124.4, 617, 618, 623, 620
See application file for complete search history.

(56) References Cited

U.S. PATENT DOCUMENTS

| | | | | |
|---|---|---|---|---|
| 138,454 A | | 4/1873 | Van Epa | |
| 358,193 A | * | 2/1887 | Gause | 248/114 |
| 384,439 A | | 6/1888 | Greenwood | |
| 933,500 A | * | 9/1909 | Towle | 40/493 |
| 1,983,994 A | * | 12/1934 | Raynor | 52/454 |
| 2,532,132 A | | 11/1950 | Vogel | 40/124 |
| 3,327,419 A | | 6/1967 | Stanos | 40/124 |
| 4,107,372 A | | 8/1978 | Clausen et al. | 428/256 |
| 4,241,527 A | * | 12/1980 | Becker | 40/124.2 |
| 4,821,883 A | * | 4/1989 | Miller | 206/495 |
| 4,852,280 A | | 8/1989 | Beattie | 40/124 |
| 5,097,961 A | | 3/1992 | Patino et al. | 211/10 |
| 5,121,833 A | * | 6/1992 | Lindsay et al. | 206/6.1 |
| 5,238,305 A | * | 8/1993 | Feller | 383/22 |
| 5,242,062 A | | 9/1993 | Engravalle | 211/45 |
| D398,465 S | * | 9/1998 | Wieder | D6/513 |
| 5,987,791 A | | 11/1999 | Paine | 40/124.4 |
| 6,088,856 A | * | 7/2000 | Boyer | 5/644 |

FOREIGN PATENT DOCUMENTS

GB 2271960 A 5/1994

OTHER PUBLICATIONS

Unique Projects—free plans: how to make a Bulletin Board, dated Jun. 2, 2003, pp. 1-8.

* cited by examiner

*Primary Examiner*—Cassandra Davis
(74) *Attorney, Agent, or Firm*—Barley Snyder LLC

(57) ABSTRACT

A card mounting and display device for mounting and displaying a plurality of cards in any desired configuration. The device includes a fabric base having an array grid netting loosely attached to a first side thereof. The array grid netting is arranged to receive fasteners for attaching the plurality of cards to the array grid netting in any desired configuration. A pocket is arranged on the base for storing the fasteners. The device can be rolled-up or folded for ease of storage.

14 Claims, 3 Drawing Sheets

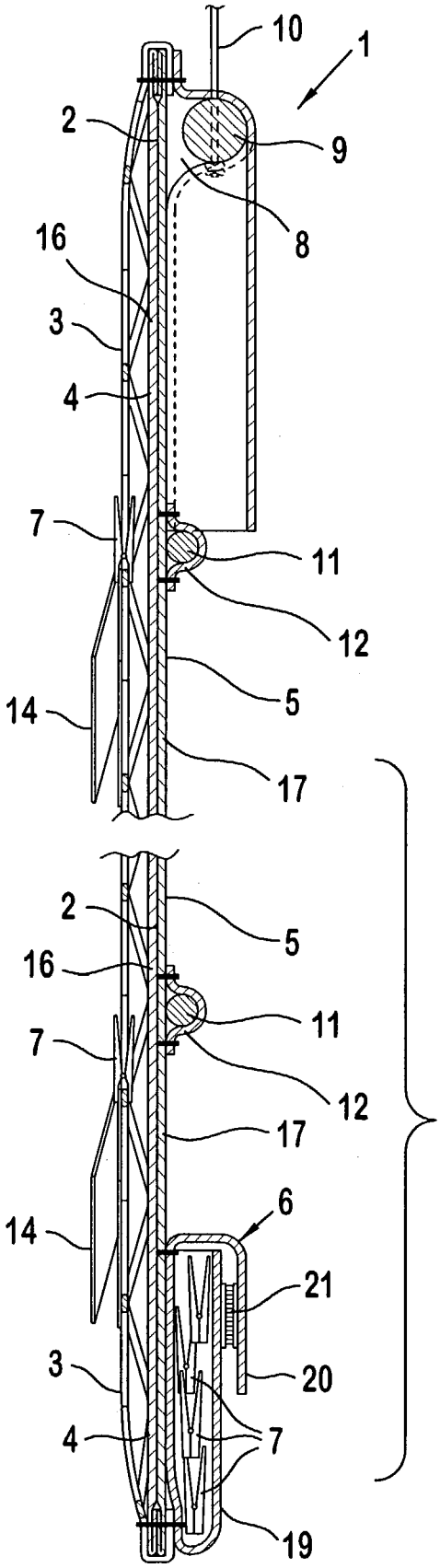
FIG. 3
FIG. 4
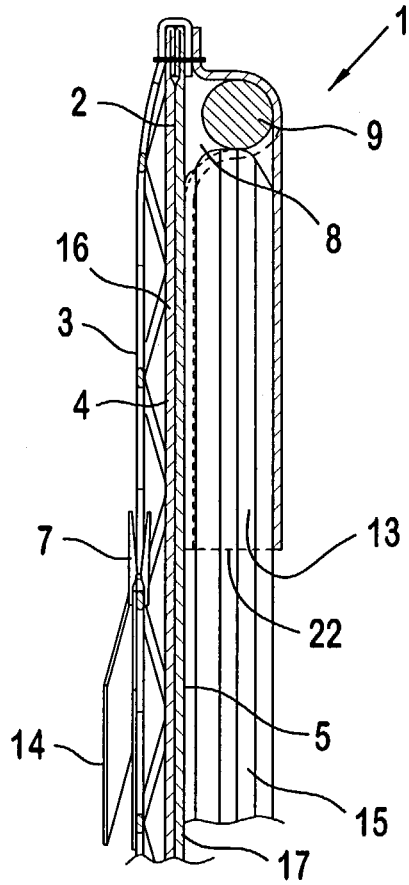

CARD MOUNTING AND DISPLAY DEVICE

FIELD OF THE INVENTION

The invention relates to a device for mounting and displaying cards and the like. More specifically, the invention relates to a device for mounting and displaying cards that is made from a base having an array grid netting for fastening and displaying cards in any desired array.

BACKGROUND OF THE INVENTION

Conventional devices used to display cards or the like generally consist of a base having a plurality of slots for inserting edges of the cards. The base supports the cards so that the cards are maintained in an upright position. The slots are either formed directly in the base or a separate card receiving member having slots is attached to a surface of the base for receiving the edges of the cards. Because the slots are pre-disposed on the base, the arrangement of the cards is limited to the positions of the slots. The slots also limit the size and types of cards capable of being displayed, since the slots can only accommodate cards equivalent to or smaller than the size of the slots and can only receive cards having substantially flat edges. The slots also prevent a portion of the cards from being viewed. Moreover, because the base has to be firm enough to either maintain the cards in an upright position or support the separate card receiving member, the device is heavy and can not be easily rolled-up or folded without damaging the device, which makes storage of the device difficult.

SUMMARY OF THE INVENTION

The invention relates to a card mounting and display device. The device includes a base having an array grid netting loosely attached to a first side thereof. The array grid netting is arranged to receive fasteners for attaching a plurality of cards to the array grid netting in any desired configuration.

BRIEF DESCRIPTION OF THE DRAWINGS

FIG. 3 is cross-sectional view of the device of FIG. 1 along line 3—3.

FIG. 4 is cross-sectional view of the device mounted on a frame.

DETAILED DESCRIPTION OF THE INVENTION

Figure 1:
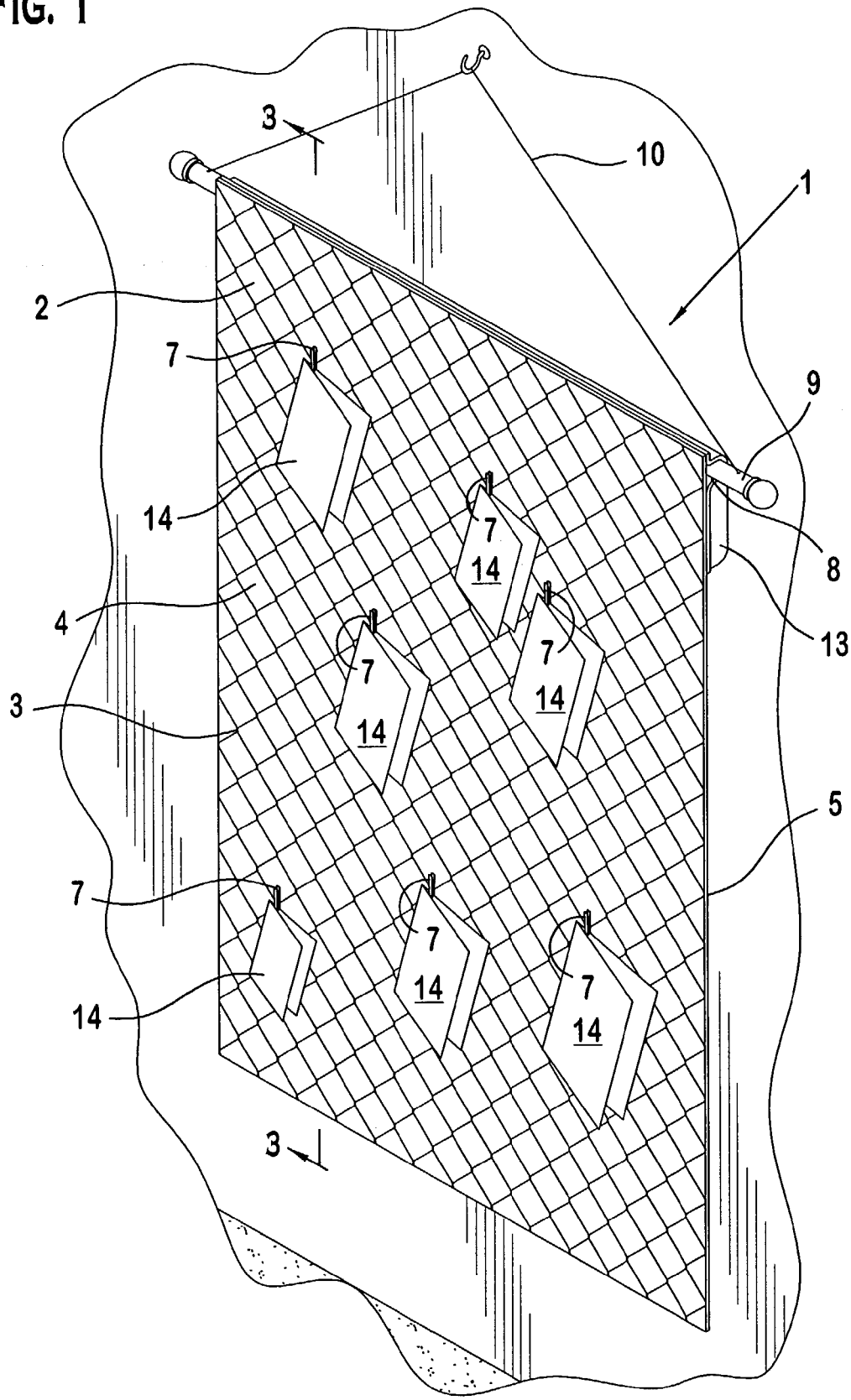
FIG. 1 is a perspective view of a first side of a card mounting and display device.
Figure 2:
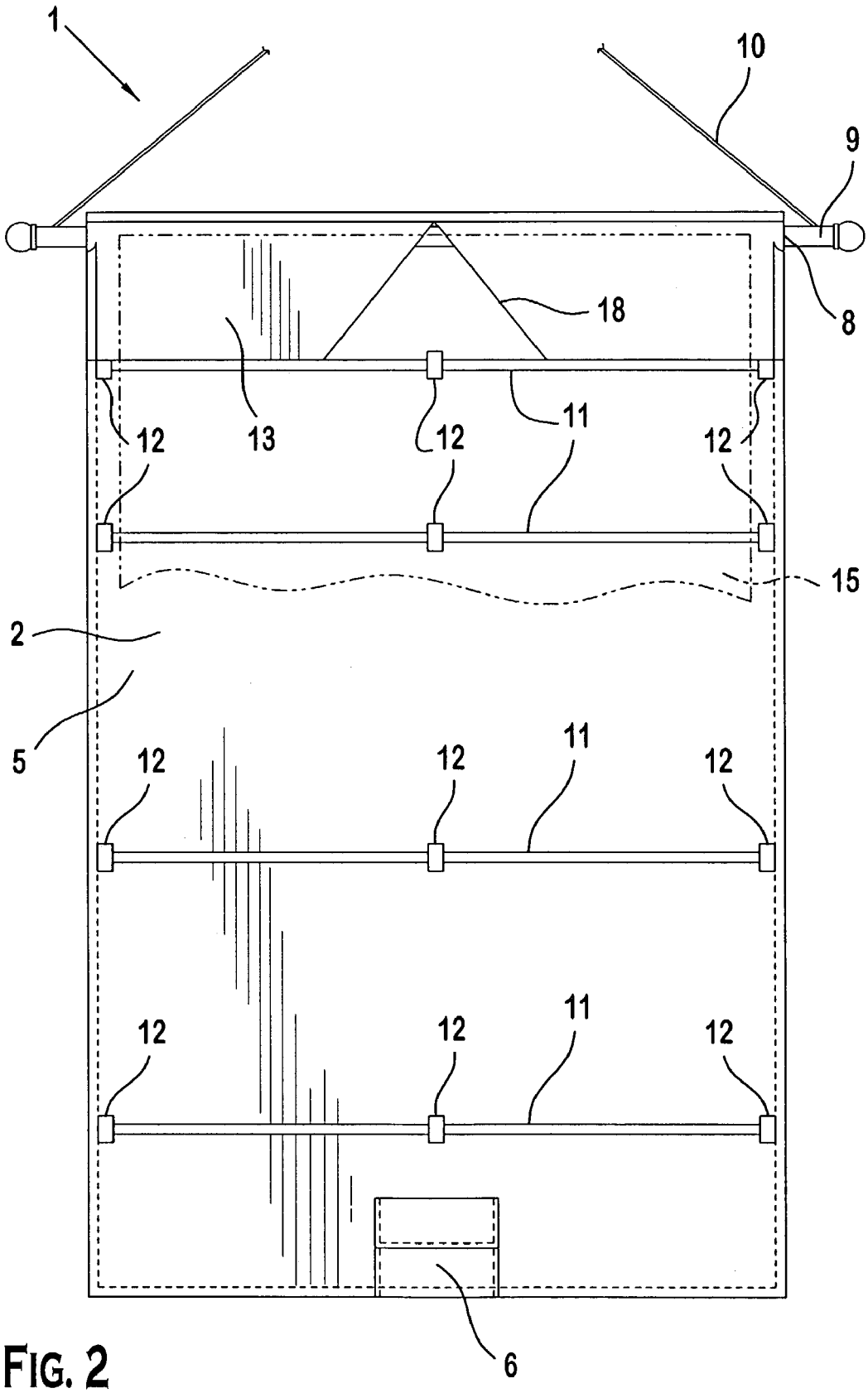
FIG. 2 is a plan view of a second side of the device of FIG. 1.

FIG. 1 shows a card mounting and display device 1 for displaying cards 14, such as greeting cards, postcards, photographs, pictures, clippings, or any other card like item desired to be displayed. The device 1 includes a base 2 having an array grid netting 3 for receiving cards 14 arranged on a first side 4. As shown in FIG. 2, a sealable pouch 6 for holding a plurality of fasteners 7 is arranged on a second side 5. The second side 5 has a plurality of reinforcing rods 11 arranged in pocket fasteners 12. A rod 9 has a string 10 fastened at ends thereof for hanging the device 1. In addition, a pocket 13 is provided for hanging the device 1. The individual elements of the device 1 and method for mounting the cards 14 to the device 1 will now be described in greater detail.

As shown in FIG. 3, a first piece 16 of material and a second piece 17 of material are attached to form the base 2. The first piece 16 is attached to the second piece 17 such that the first piece 16 of material forms the first side 4, and the second piece 17 of material forms the second side 5 of the device 1. In the embodiment illustrated in FIG. 2, the first piece 16 of material is attached to the second piece 17 of material by stitching around an outer perimeter of the first and second pieces 16, 17. The first piece 16 could also be attached to the second piece 17 by other known means of attachment, such as adhesive, snaps, etc. The first and second pieces 16, 17 of material are made from a supple material, such as decorative cloth, felt, or fabric, which enables the device 1 to be easily folded or rolled-up without damaging the device 1. The first and second pieces 16, 17 of material may be made from the same material or from different materials depending on the desired aesthetic appearance of the finished device 1. Although the base 2 is illustrated as being substantially rectangular in shape, the base 2 may be any of a variety of desired shapes or sizes. The base 2 may also be formed from a single piece of material.

As shown in FIG. 1, the array grid netting 3 is arranged on the first side 4 of the base 2 to form a card attachment area. The array grid netting 3 is formed from any material flexible enough to be rolled or folded-up without damaging the array grid and having a grid with openings of a size capable of receiving the fasteners 7. Examples of materials that may be used for the array grid netting 3 are fish netting made from a natural material such as decorative cotton, fish netting made from a synthetic material such as nylon or flexible plastic, bridal veiling, natural or synthetic lace, loosely woven yard goods, ribbons, etc. The array grid netting 3 is loosely attached to the first side 4 of the base 2 such that the array grid netting 3 is capable of receiving a fastener 7 that fixes the cards 14 to the array grid netting 3. In the illustrated embodiment, the array grid netting 3 covers the entire first side 4 of the base 2 and is fastened to ends of the base 2 by stitching or adhesion. Alternatively, the array grid netting 3 may cover only a portion of the base 2 depending on the desired configuration of the card attachment area and may be fastened to the base 2 in a variety of locations while still maintaining the ability to receive the fasteners 7.

As shown in FIG. 2, the sealable pouch 6 is arranged on the second side 5 of the base 2. As shown more clearly in FIG. 3, the sealable pouch 6 has a pouch 19 for receiving a plurality of fasteners 7 and a flap 20 for covering an entrance to the pouch 19. The sealable pouch 6 may be made from the same material as the second piece 17. In the illustrated embodiment, the sealable pouch 6 is attached by sewing or adhesion to a bottom of the base 2 for ease of access from the first side 4. Alternatively, the sealable pouch 6 may be arranged on the base 2 in any position and on any side thereof. The base 2 may also be provided without a sealable pouch 6. The flap 20 and the pouch 19 may be provided with an attachment device 21, such as VELCRO, snaps, buttons, etc., for sealing the pouch 19 while leaving the fasteners 7 easily accessible.

As shown in FIGS. 2 and 3, a top of the base 2 is provided with a slot 8 for receiving the rod 9. The rod 9 has a string 10 attached at ends thereof for hanging the device 1. The second side 5 is also provided with the pocket 13. The pocket 13 may be formed from the same material as the second side 17 and has an opening 22 for receiving a frame 15, such as a picture frame already mounted on a wall. A cutout 18 is formed in substantially a center of the pocket 13 to facilitate insertion of the frame 15 therein. Although the device 1 is illustrated as being provided with the rod 9 and the pocket 13 such that the device can be hung in two different ways, alternatively, the device 1 may be provided with the rod 9 or the pocket 13.

As shown in FIG. 2, a plurality of the reinforcing rods 11 are arranged horizontally across the second side 5. The reinforcing rods 11 are received in pocket fasteners 12 provided on the second side 5. As best shown in FIG. 3, the pocket fasteners 12 have ends attached to the base 2 to form an opening for receiving the reinforcing rods 11. The pocket fasteners 12 may be made out of the same material as the second piece 17. In the illustrated embodiment, each reinforcing rod 11 corresponds to three pocket fasteners 12, two pocket fasteners arranged at the edges of the base 2 and one pocket fastener arranged in substantially the center of the base 2. The reinforcing rods 11 are inserted into the pocket fasteners 12 to support the base 2 and may be removed from the pocket fasteners 12 for ease of storage. Alternatively, the reinforcing rods 11 may be arranged vertically and may be directly fixed to the base 2.

As shown in FIG. 3, the fasteners 7 are illustrated as being a plurality of miniature clothespins. Alternatively, the fasteners 7 may be any type of fastening device that is capable of removably attaching the cards 14 to the array grid netting 3 without damaging or altering the cards 14. The fasteners 7 may also be of any design, color, or shape depending on the desired use of the device 1.

The method of attaching the cards 14 to the device 1 will now be described in greater detail. The device 1 is displayed by either positioning the string 10 of the rod 9 on a nail, hook, etc. previously mounted on a wall, as shown in FIG. 1, or by inserting the frame 15 already hung on the wall into the opening of the pocket 13, as shown in FIG. 4. The frame 15 is inserted such that a top of the frame 15 abuts the rod 9. The fasteners 7 are removed from the sealable pouch 6. One of the cards 14 is positioned adjacent to the array grid netting 3. The fastener 7 is fastened over the card 14 and the array grid netting 3 to fasten the card 14 to the array grid netting 3. Any number of the cards 14 may be fastened to the array grid netting 3 in any desired configuration. The cards 14 may be fastened to the array grid netting 3 such that the cards may be opened and viewed while still remaining attached to the device 1.

When the device 1 is no longer desired to be used, the cards 14 are removed from the array grid netting 3, by removing the fasteners 7. The fasteners 7 are returned to the sealable pouch 6 for storage. The device 1 is removed from the wall and is either folded or rolled-up for storage. The reinforcing rods 11 may optionally be removed from the device 1 before the device 1 is folded or rolled-up for storage. Because the device 1 is made of a supple material, the device 1 may be safely and easily stored without damaging the device 1. The device 1 may also be stored with the cards 14 still fastened thereto.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A card mounting and display device, comprising:

a base having an array grid netting loosely attached to a first side thereof, the array grid netting arranged to receive fasteners for attaching a plurality of cards to the array grid netting in any desired configuration;

a sealable pouch directly attached to a second side of the base for storing the fasteners used to attach the plurality of cards to the array grid netting; and a rod attached to the base, the rod including a string attached to ends thereof for hanging the device.

2. The device of claim 1, further comprising a pocket arranged on the second side of the base, the pocket including an opening for receiving a frame for hanging the device.

3. The device of claim 2, wherein the pocket includes a cutout for facilitating receipt of the frame into the pocket.

4. The device of claim 1, further comprising a reinforcing rod arranged on the second side of the base.

5. The device of claim 4, further comprising pocket fasteners attached to the second side of the base for removeably receiving the reinforcing rod.

6. The device of claim 1, wherein the base is made from a supple material that can be rolled or folded for facilitating storage of the device.

7. The device of claim 1, wherein the array grid netting is made from knotted cord.

8. A card mounting and display device, comprising:

a fabric base having an array grid netting loosely attached to a first side thereof, the array grid netting arranged to receive fasteners for attaching a plurality of cards to the array grid netting in any desired configuration;

a pocket arranged on a second side of the base opposite from the first side, the pocket including an opening configured for receiving a frame for hanging the device; and a reinforcing rod arranged on the second side of the base.

9. The device of claim 8, further comprising a sealable pouch arranged on the base for storing the fasteners used to attach the plurality of cards to the array grid netting.

10. The device of claim 8, further comprising a rod attached to the base, the rod including a string attached to ends thereof for hanging the device.

11. The device of claim 8, wherein the pocket includes a cutout for facilitating receipt of the frame into the pocket.

12. The device of claim 8, further comprising pocket fasteners attached to the second side of the base for removeably receiving the reinforcing rod.

13. The device of claim 8, wherein the array grid netting is made from knotted cord.

14. The device of claim 8, wherein the array grid netting is attached only at ends of the device.

* * * * *